US012774508B2

(12) United States Patent
Liu et al.

(10) Patent No.: US 12,774,508 B2
(45) Date of Patent: Oct. 27, 2026

(54) HIGH-STRENGTH Al—Cu—Mg—Mn ALUMINUM ALLOY AND PREPARATION METHOD THEREFOR

(71) Applicant: CENTRAL SOUTH UNIVERSITY, Changsha (CN)

(72) Inventors: Zuming Liu, Changsha (CN); Xu Zhou, Changsha (CN); Yake Ren, Changsha (CN); Bizhong Nong, Changsha (CN); Sizhe Lu, Changsha (CN); Bin Cao, Changsha (CN); Yongkang Ai, Changsha (CN); Bing Wei, Changsha (CN); Xueqian Lv, Changsha (CN)

(73) Assignee: CENTRAL SOUTH UNIVERSITY, Changsha (CN)

( * ) Notice: Subject to any disclaimer, the term of this patent is extended or adjusted under 35 U.S.C. 154(b) by 904 days.

(21) Appl. No.: 18/023,733

(22) PCT Filed: Aug. 31, 2020

(86) PCT No.: PCT/CN2020/112715

§ 371 (c)(1),
(2) Date: Sep. 4, 2023

(87) PCT Pub. No.: WO2022/041268

PCT Pub. Date: Mar. 3, 2022

(65) Prior Publication Data

US 2024/0035123 A1 Feb. 1, 2024

(30) Foreign Application Priority Data

Aug. 30, 2020 (CN) ..... 202010891335.2

(51) Int. Cl.
*C22F 1/057* (2006.01)
*C22C 1/02* (2006.01)
(Continued)

(52) U.S. Cl.
CPC ..... *C22C 21/16* (2013.01); *C22C 1/026* (2013.01); *C22C 1/03* (2013.01); *C22C 21/14* (2013.01); *C22F 1/057* (2013.01)

(58) Field of Classification Search
CPC ..... C22F 1/04–057
See application file for complete search history.

(56) References Cited

FOREIGN PATENT DOCUMENTS

CN 101240390 A 8/2008
CN 101484604 A 7/2009
(Continued)

OTHER PUBLICATIONS

Fangfang Sun, et al., Effect of Sc and Zr addilions on microstructures and corrosion behavior of Al—Cu—Mg—Sc—Zr alloys, Journal of Materials Science & Technology, 2017, pp. 1015-1022, vol. 33.

(Continued)

*Primary Examiner* — Lois L Zheng
(74) *Attorney, Agent, or Firm* — Bayramoglu Law Offices LLC

(57) ABSTRACT

A high-strength Al—Cu—Mg—Mn aluminum alloy and a preparation method therefor is provided. The alloy includes the following components in percentage by weight: Si: ≤0.5%, Fe: ≤0.5%, Cu: 4.5-6.3%, Mg: 0.6-1.2%, Mn: 0.6-1.5%, Sc: 0.15-0.35%, Zr: 0.1-0.2%, and Y: 0.1-0.3%, the balance being aluminum and non-removable impurities. The preparation method includes: smelting, refining, impurity removing and degassing, pouring, homogenizing heat treatment, three-dimensional large deformation forging pre-deformation, isothermal deformation processing, and heat treatment. A casting mold used is a special combined mold having a metal mold as an inner mold, a surrounding cooling pipe, and a sand mold as an outer mold, and is used to prepare and obtain high-quality, high-performance castings.

(Continued)

The heat treatment is solid solution treatment plus gradient aging treatment. The Al—Cu—Mg—Mn aluminum alloy has a tensile strength higher than 520 MPa and an elongation of 12-16%, that is, an increased elongation rate and improved strength.

12 Claims, 1 Drawing Sheet

(51) Int. Cl.

| | |
|---|---|
| ***C22C 1/03*** | (2006.01) |
| ***C22C 21/12*** | (2006.01) |
| ***C22C 21/14*** | (2006.01) |
| ***C22C 21/16*** | (2006.01) |

(56) References Cited

FOREIGN PATENT DOCUMENTS

| | | | |
|---|---|---|---|
| CN | 103748246 | A | 4/2014 |
| CN | 105441759 | A | 3/2016 |
| CN | 108342628 | A | 7/2018 |
| CN | 111020320 | A | 4/2020 |
| JP | 2017128789 | A | 7/2017 |

OTHER PUBLICATIONS

Liao Simin, et al., Microstructural evolution of Al—Cu—Mg—Mn—Sc—Zr alloy during homogenization, Heat Treatment of Metals, 2020, pp. 55-59, vol. 45 No. 4.

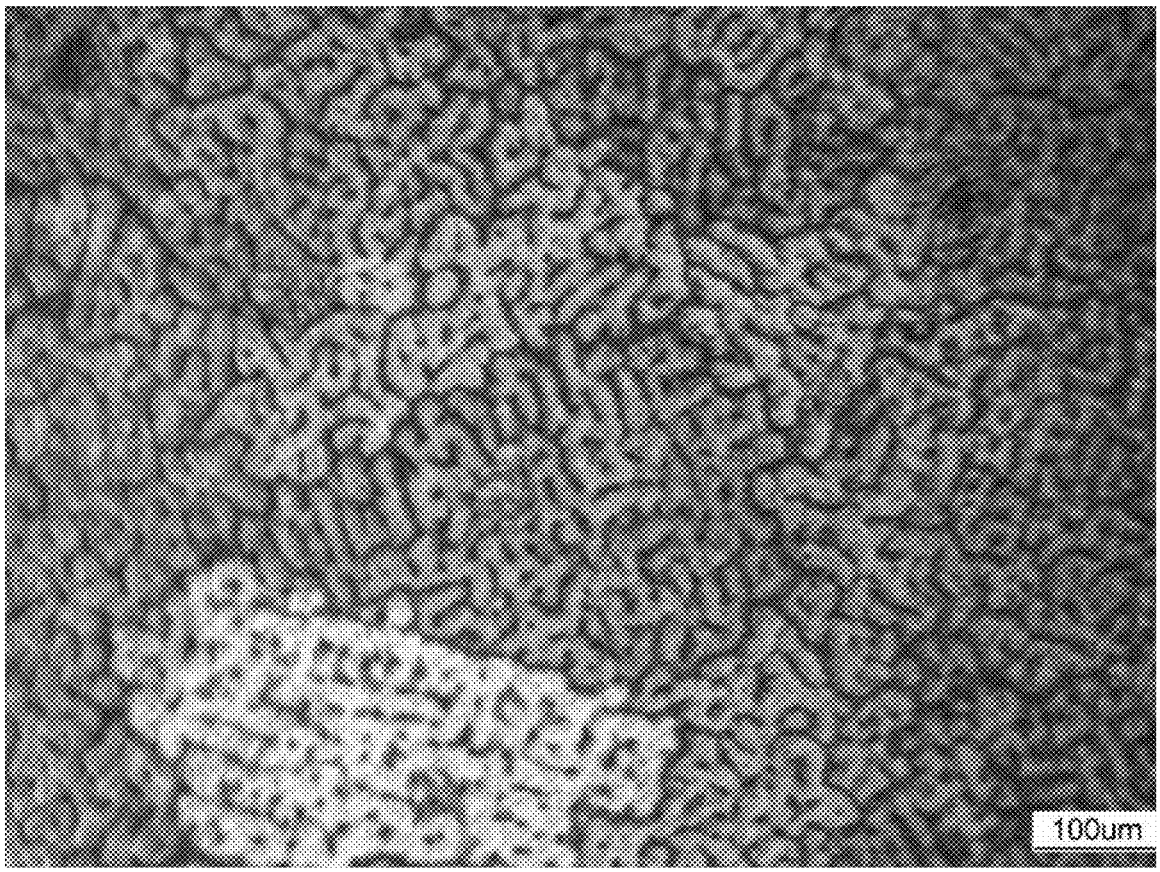
100um

HIGH-STRENGTH Al—Cu—Mg—Mn ALUMINUM ALLOY AND PREPARATION METHOD THEREFOR

This application is the national stage entry of International Application No. PCT/CN2020/112715 filed Aug. 31, 2020, and which is based upon and claims priority to Chinese Patent Application No. 202010891335.2 filed Aug. 30, 2020, the entire contents of which are incorporated by reference herein.

TECHNICAL FIELD

The present disclosure provides a high-strength Al—Cu—Mg—Mn aluminum alloy and a preparation method therefor, relating to the field of aluminum alloys.

BACKGROUND

Al—Cu—Mg—Mn aluminum alloys have the characteristics of low density, high strength and excellent plasticity, and excellent electrical and thermal conductivity, and have been widely used in the industrial field, especially as an important structural material for aircrafts in the fields of aviation and aerospace. Aircraft fuselage joints, frames, hubs and other supporting structural components can be made of aluminum alloys.

The tensile strength and fatigue resistance of Al—Cu—Mg—Mn aluminum alloys currently used are low, and it is necessary to further optimize the microstructure of such alloys to improve the performance to meet the requirements of aerospace. Adding the element Sc to aluminum alloys can refine grains and improve the strength and machinability of the alloys. Sun et al. (Fangfang Sun, et al. Effect of Sc and Zr additions on microstructures and corrosion behavior of Al—Cu—Mg—Sc—Zr alloys [J]. Journal of Materials Science & Technology, 2017, 33(9): 1015-1022) added 0.1% of Sc and 0.2% of Zr to an Al-4.12Cu-1.89Mg alloy, which reached a tensile strength of 436 MPa and an elongation of 13.64% after being deformed by rolling and subjected to solid solution and aging treatment.

Chinese patent CN103748246A disclosed a heat-resistant Al—Cu—Mg—Ag alloy and a method for producing a semi-finished part or product composed of the aluminum alloy. The composition of the alloy includes: 0.3-0.7 wt % of silicon, no more than 0.15 wt % of iron, 3.5-4.7 wt % of copper, 0.05-0.5 wt % of manganese, 0.3-0.9 wt % of magnesium, 0.02-0.15 wt % of titanium, 0.03-0.25 wt % of zirconium, 0.1-0.7 wt % of silver, 0.03-0.5 wt % of scandium, 0.03-0.2 wt % of vanadium, no more than 0.05 wt % of single other elements, no more than 0.15 wt % of all other elements, and the balance of aluminum. The tensile strength and elongation of the prepared aluminum alloy are 449 MPa and 10.6%.

Chinese patent CN105441759A disclosed a Sc-containing high-strength Al—Cu—Mg—Mn—Zr alloy and a preparation method therefor. The composition of the alloy includes: 3.7%-4.0% of copper, 1.4%-1.6% of magnesium, 0.2%-0.3% of scandium, of zirconium, 0.3%-0.5% of manganese, and the balance of aluminum. With the addition of Sc and Zr, the prepared aluminum alloy had a tensile strength of 450-520 MPa at room temperature and an elongation of 6.5%-11.5% after being deformed by rolling.

The present disclosure provides a high-strength Al—Cu—Mg—Mn aluminum alloy and a preparation method therefor. In the present disclosure, a high-quality ingot is prepared through microalloying using Sc, Zr, and Y in combination of casting process control. The ingot is pre-deformed by three-dimensional large deformation multi-directional forging, and then processed by isothermal extrusion or isothermal forging deformation processing, to achieve substructure strengthening while avoiding the increase of deformation energy. The prepared alloy reached a tensile strength of 530 MPa and an elongation of 10-16% after solid solution and aging treatment.

SUMMARY

To solve the problems of low tensile strength, impact toughness and fatigue resistance of Al—Cu—Mg—Mn aluminum alloys, the present disclosure provides a high-strength Al—Cu—Mg—Mn aluminum alloy and a preparation method therefor. A high-quality ingot is prepared through microalloying using Sc, Zr, and Y in combination of casting process control. The ingot is pre-deformed by three-dimensional large deformation multi-directional forging, and then processed by isothermal extrusion or isothermal forging deformation processing, to achieve substructure strengthening while avoiding the increase of deformation energy. With solid solution treatment and gradient aging treatment, both the strength and elongation of the aluminum alloy are improved.

The present disclosure provides a high-strength Al—Cu—Mg—Mn aluminum alloy, including the following components in percentage by weight: Cu 4.5-6.3%, Mg: 0.6-1.2%, Mn: 0.6-1.5%, Si: ≤0.5%, Fe: ≤0.5%, Sc: 0.15-0.35%, Zr: 0.1-0.2%, and Y: 0.1-0.3%, the balance being aluminum and non-removable impurities, wherein Sc and Zr are added at a weight ratio of 1-3:1.

Further, the aluminum alloy comprises the following components in percentage by weight: Cu 4.5-5.2%, Mg: 0.6-1.0%, Mn: 0.6-1.5%, Si: ≤0.5%, Fe: ≤0.5%, Sc: 0.2-0.3%, Zr: 0.12-0.15%, and Y: 0.2-0.3%, the balance being aluminum and non-removable impurities, wherein Sc and Zr are added at a weight ratio of 1-3:1.

Further, the aluminum alloy comprises the following components in percentage by weight: Cu 5.0%, Mg: 0.6%, Mn: 1.0%, Si: ≤0.5%, Fe: ≤0.5%, Sc: 0.26%, Zr: 0.13%, wherein Sc:Zr=2:1, and Y: 0.3%, the balance being aluminum and non-removable impurities.

A method for preparing the high-strength Al—Cu—Mg—Mn aluminum alloy includes the following steps:

A. smelting: using high-purity aluminum, high-purity magnesium, an aluminum-copper intermediate alloy, an aluminum-scandium intermediate alloy, an aluminum-manganese intermediate alloy, an aluminum-zirconium intermediate alloy, and an aluminum-yttrium intermediate alloy as raw materials, wherein the purity of the high-purity aluminum is ≥99.9%, the purity of the high-purity magnesium is ≥99.9%, the content of copper in the aluminum-copper intermediate alloy is ≥50.0%, the content of scandium in the aluminum-scandium intermediate alloy is ≥1.0%, the content of zirconium in the aluminum-zirconium intermediate alloy is ≥10.0%, the content of manganese in the aluminum-manganese intermediate alloy is ≥20.0%, and the content of yttrium in the aluminum-yttrium intermediate alloy is ≥10.0%; and weighing the raw materials according to a formulation ratio, and heating and melting the raw materials in a resistance furnace;

B. mold making: designing and preparing a steel mold of a particular size (having a wall thickness of greater than or equal to 30 mm) as an inner mold according to a size of an aluminum alloy ingot; winding a cooling pipe upward from a bottom portion of an outer wall of the steel mold; introducing cooling water into the cooling pipe, wherein the temperature and flow of the cooling water are controllable; and using a sand mold as an outer mold, wherein a thickness ratio of the steel mold to the sand mold is 1:(2-5), a steel mold pouring system is used, and a cooling speed is controlled by controlling the temperature and flow of the cooling water;

C. refining, impurity removing, and degassing: after the metal melt is fully alloyed, adding an impurity removal agent into the alloy melt for slagging, introducing argon gas for min, standing and skimming, repeating the operations for 2-3 times, and then standing the aluminum alloy melt for more than 20 min;

D. pouring: after the refining, impurity removal and degasification of the aluminum alloy melt are completed, maintaining the melt at a temperature of 720±5° C., and pouring the melt to the mold prepared in the step B to cool and solidify to obtain an ingot;

E. homogenizing heat treatment: heating the ingot obtained in the step D to 480±10° C., holding for 13-15 h, taking the ingot out of the furnace, and air cooling to room temperature;

F. forging pre-deformation: heating the homogenized ingot obtained in the step E in a resistance furnace to 420-450° C. and holding for 30-60 min, preferably 40-50 min, and more preferably 45 min, and then conducting three-dimensional large deformation multi-directional forging, with a reduction rate of 1-3 mm/s, preferably 2 mm/s; wherein for a first deformation, perform reduction deformation along a maximum dimension direction (Y axis), and when a strain of 0.5-0.8 is reached, perform a first turnover reversing deformation, that is, the second deformation: conducting reversing deformation for multiple times along a radial direction (X axis) perpendicular to the first pressure direction (Y axis), to obtain a multi-rhombus cylindrical blank, and when a strain of 0.5-0.8 is reached, a second reversing deformation is conducted, that is, the third deformation: conducting reversing deformation for multiple times along a maximum dimension direction between the X axis and the Y axis to obtain a spherical polyhedron; the steps are repeated for 3-5 times; and finally, reversing deformation is conducted along the X axis to obtain a final multi-rhombus cylindrical blank, this is final deformation;

G. isothermal deformation processing: holding the final blank obtained in the step F at 420-450° C. for 1-2 h, preferably 1.5 h, and holding the mold at 420-450° C. for 25-35 min, with an extrusion ratio of (10-20):1 and an extrusion speed ensuring that an ingot strain rate is 0.05-0.2 $s^{-1}$; or isothermal forging: holding the blank at 420-450° C. for 1-2 h, and holding the mold at 420-450° C. for 25-40 min, wherein a punching speed of a hydraulic press during forging is 0.05-0.1 mm/s preferably 0.05 mm/s, to obtain an isothermally deformed workpiece; and H. heat treatment: first, conducting solid solution treatment: heating the isothermal deformed workpiece in the step G to 480-520° C., holding for 1-3 h, taking the workpiece out of the furnace, and water quenching; and then conducting gradient aging treatment: first, heating the workpiece obtained after the solution treatment to 100-130° C. for 0.5-1.5 h, then heating to 170-220° C. for 5.0-10.0 h, and air cooling to obtain a product.

As a further improvement to the above solution, in the step A, the temperature of the melt after heating is 750-800° C.

As a further improvement to the above solution, in the step F, the homogenized ingot obtained in the step E is heated in the resistance furnace to 420-450° C. and held for 45 min, and then three-dimensional large deformation multi-directional forging is conducted, with a reduction rate of 2 mm/s; for the first deformation, the reduction deformation is carried out along the maximum dimension direction (Y axis), and when a strain of 0.5 is reached, the first turnover reversing deformation is conducted: conducting the reversing deformation for multiple times along the radial direction (X axis) perpendicular to the first pressure direction (Y axis), to obtain the multi-rhombus cylindrical blank, and when a strain of 0.5 is reached, the second reversing deformation is conducted: conducting the reversing deformation for multiple times along the dimension direction of the maximum dimension direction between the X axis and the Y axis to obtain the spherical polyhedron; the steps are repeated for 3-5 times; and finally, the reversing deformation is conducted along the X axis to obtain the multi-rhombus cylindrical blank;

As a further improvement to the above solution, in the step G, an isothermal deformation process is used: holding the blank at 420-450° C. for 1.5 h, and holding the mold at 420-450° C. for 30 min, with an extrusion ratio of (10-20):1 and an extrusion speed ensuring that the ingot strain rate is 0.1 $s^{-1}$; or isothermal forging is used: holding the blank at 420-450° C. for 1.5 h, and holding the mold at 420-450° C. for 30 min, wherein the punching speed of the hydraulic press during forging is 0.05 mm/s.

As a further improvement to the above solution, in the step H, the solid solution treatment includes: heating the isothermally deformed workpiece to 500° C., holding for 2 h, taking the workpiece out of the furnace, and water quenching.

As a further improvement to the above solution, in the step H, the gradient aging treatment includes: first, heating the workpiece obtained after the solution treatment to 120° C. for 1 h, then heating to 200° C. for 7 h, and air cooling to obtain the product.

The product designed and prepared by the present disclosure has a tensile strength of 520-530 MPa and an elongation of 12%-16%.

The present disclosure has the following advantages and positive effects.

1. In the present disclosure, Sc, Y and Zr are used to micro-alloy the aluminum alloy, to form second phases dispersed in the aluminum alloy, thereby improving the recrystallization temperature. In addition, an Al3 (ScxZr1-x) composite phase may also be formed, which has higher thermal stability. Therefore, the prepared aluminum alloy has higher strength and thermal stability, thereby prolonging the service life and improving the service temperature of the aluminum alloy.

2. In the preparation process of the present disclosure, the purity of the material is strictly controlled, and the contents of Fe and Si are reduced, to prevent the formation of coarse brittle phases that affect the plasticity of the alloy. In addition, with the use of micro-alloying elements such as Y, Sc and Zr to refine grains, the segregation degree of alloying elements is improved, thereby improving the mechanical properties of the alloy.

3. The present disclosure proposes the use of three-dimensional large deformation multi-directional forging to process the alloy ingot, so that the ingot microstructure can be homogenized, especially the coarse second phase can be fully broken and homogenized, thereby improving the comprehensive properties of the alloy and providing a blank with uniform microstructure for subsequent deformation processing. A deformed microstructure with uniform deformation, uniform distribution of fine second phases, and excellent mechanical properties are obtained by isothermal extrusion or isothermal forging deformation processing.

4. In the present disclosure, uniformly distributed multi-scale nano second phases are formed through the joint action of gradient aging, low-temperature aging and high-temperature aging, thereby effectively improving the microstructural uniformity and mechanical properties.

5. For the mold for casting the aluminum alloy of the present disclosure, by using the metal mold as the inner mold, winding the water-cooling pipe, and then using the sand mold as the outer mold, the cooling speed is improved, the grains are refined, the mold making costs are reduced, and the quality of the ingot is ensured. By controlling the water temperature and flow speed to adjust the melt solidification rate in cooperation with the outer sand mold so as to adjust the microstructure of the ingot, the grain size uniformity and composition uniformity of the surface layer and central part of the casting are improved, and the casting with uniform microstructure and composition is obtained.

6. The process provided by the present disclosure is simple and can effectively avoid defects such as sand inclusion and coarse microstructure of the ingot due to the slow cooling of the sand mold and the direct contact of the melt with the molding sand. The cooling speed of the metal mold is fast, but the structural uniformity between the surface layer and the central part of the casting is poor. In order to improve the uniformity of the microstructure, it is necessary to increase the size of the mold, which leads to the high costs of the metal mold and the processing difficulty. The present disclosure involves a simple process, low production costs, good ingot quality, a compact microstructure and excellent performance. Compared with casting with a sand mold, the mechanical properties of the ingot prepared by the present disclosure are better. Compared with casting with a metal mold, the microstructure of the central part can be effectively controlled, and the surface layer and central part of the prepared casting have good microstructural uniformity and composition uniformity. The prepared aluminum alloy casting has a compact microstructure, small grain size and uniform composition, which is conducive to plastic processing of the aluminum alloy.

7. The tensile strength of the aluminum alloy prepared by the present disclosure is higher than 520 MPa, and the elongation is increased to 12-16%. In other words, the elongation is increased while improving the strength. The excellent comprehensive performance is of great significance for high-strength and high-toughness aluminum alloys.

BRIEF DESCRIPTION OF THE DRAWINGS

In order to make the technical solutions and beneficial effects of the present disclosure clearer, the following drawing is provided for further explanation:

The FIGURE is a metallographic and microstructure photo of an Al—Cu—Mg—Mn aluminum alloy ingot prepared in Example 1.

DETAILED DESCRIPTION

The present disclosure will be further described in conjunction with examples and comparative examples.

Example 1

A high-strength Al—Cu—Mg—Mn aluminum alloy includes the following components in percentage by weight: Cu: 5.0%, Mg: 0.6%, Mn: 1.0%, Si: ≤0.5%, Fe: ≤0.5%, Sc: 0.26%, Zr: 0.13%, wherein Sc:Zr=2:1, and Y: 0.3%, the balance being aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, the content of scandium in the aluminum-scandium intermediate alloy is 2.0%, the content of zirconium in the aluminum-zirconium intermediate alloy is 40.0%, the content of manganese in the aluminum-manganese intermediate alloy is 20.0%, and the content of yttrium in the aluminum-yttrium intermediate alloy is 10%; and weighing the raw materials according to a formulation ratio, and heating and melting the raw materials in a resistance furnace, wherein the temperature of the melt is 750-800° C.;

B. mold making: designing and preparing a steel mold of a particular size (having a wall thickness equal to 30 mm) as an inner mold according to a size of an aluminum alloy ingot; winding a cooling pipe upward from a bottom portion of an outer wall of the steel mold; introducing cooling water into the cooling pipe, with a water temperature of 10° C. and a flow rate of 1 m/s; and using a sand mold as an outer mold, wherein a thickness ratio of the steel mold to the sand mold is 1:2, and a steel mold pouring system is used;

C. refining, impurity removing, and degassing: after the metal melt is fully alloyed, adding an impurity removal agent into the alloy melt for slagging, introducing argon gas for 20 min, standing and skimming, repeating the above process for 2 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 13 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times along a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of 15:1 and an extrusion speed ensuring that the ingot strain rate is 0.1 $s^{-1}$;

H. heat treatment: first, conducting solid solution treatment: heating the isothermal extruded workpiece in the step G to 500° C., holding for 2 h, taking the workpiece out of the furnace, and water quenching; and then conducting gradient aging treatment: first, heating the workpiece obtained after the solution treatment to 120° C. for 1.0 h, then heating to 200° C. for 7.0 h, and air cooling to obtain a product.

Example 2

A high-strength Al—Cu—Mg—Mn aluminum alloy includes the following components in percentage by weight: Cu: 4.6%, Mg: 0.6%, Mn: 0.8%, Sc: 0.3%, Zr: 0.1%, wherein Sc:Zr=3:1, and Y: 0.3%, the balance being pure aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, the content of scandium in the aluminum-scandium intermediate alloy is 2.0%, the content of zirconium in the aluminum-zirconium intermediate alloy is 40.0%, the content of manganese in the aluminum-manganese intermediate alloy is 20.0%, and the content of yttrium in the aluminum-yttrium intermediate alloy is 10%; and weighing the raw materials according to a formulation ratio, and heating and melting the raw materials in a resistance furnace, wherein the temperature of the melt is 750-800° C.;

B. mold making: designing and preparing a steel mold of a particular size (having a wall thickness of 40 mm) as an inner mold according to a size of an aluminum alloy ingot; winding a cooling pipe upward from a bottom portion of an outer wall of the steel mold; introducing cooling water into the cooling pipe, with a water temperature of 10° C. and a flow rate of 1 m/s; and using a sand mold as an outer mold, wherein a thickness ratio of the steel mold to the sand mold is 1:2, and a steel mold pouring system is used;

C. refining, impurity removing, and degassing: after the metal melt is fully alloyed, adding a covering agent into the alloy melt for slagging, introducing argon gas for 20 min, standing and skimming, repeating the above process for 2 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 14 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times along a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of 20:1 and an extrusion speed ensuring that the ingot strain rate is 0.1 $s^{-1}$;

H. heat treatment: first, conducting solid solution treatment: heating the isothermally extruded workpiece in the step G to 500° C., holding for 2 h, taking the workpiece out of the furnace, and water quenching; and then conducting gradient aging treatment: first, heating the workpiece obtained after the solution treatment to 120° C. for 1.0 h, then heating to 200° C. for 7.0 h, and air cooling to obtain a product.

Comparative Example 1

An Al—Cu—Mg—Mn aluminum alloy without Sc and Zr includes the following components in percentage by weight: Cu: 4.6%, Mg: 0.6%, and Mn: 0.8%, the balance being pure aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, and the content of manganese in the aluminum-manganese intermediate alloy is 20.0%; and weighing the raw materials according to a formulation ratio, and heating and melting the raw materials in a resistance furnace, wherein the temperature of the melt is 750-800° C.;

B. mold making: designing and preparing a steel mold of a particular size (having a wall thickness equal to 30 mm) as an inner mold according to a size of an aluminum alloy ingot; winding a cooling pipe upward from a bottom portion of an outer wall of the steel mold; introducing cooling water into the cooling pipe, with a water temperature of 10° C. and a flow rate of 1 m/s; and using a sand mold as an outer mold, wherein a thickness ratio of the steel mold to the sand mold is 1:2, and a steel mold pouring system is used;

C. refining, impurity removing, and degassing: after the metal melt is fully alloyed, adding a covering agent into the alloy melt for slagging, introducing argon gas for 20 min, standing and skimming, repeating the above process for 2 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 14 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times along a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of and an extrusion speed ensuring that the ingot strain rate is 0.1 $s^{-1}$;

H. heat treatment: first, conducting solid solution treatment: heating the isothermal extruded workpiece in the step G to 500° C., holding for 2 h, taking the workpiece out of the furnace, and water quenching; and then conducting gradient aging treatment: first, heating the workpiece obtained after the solution treatment to 120° C. for 1.0 h, then heating to 200° C. for 7.0 h, and air cooling to obtain a product.

Comparative Example 2

An Al—Cu—Mg—Mn aluminum alloy includes the following components in percentage by weight: Cu: 4.6%, Mg: 0.6%, Mn: 0.8%, Sc: 0.26%, Zr: 0.13%, wherein Sc:Zr=2:1, and Y: 0.3%, the balance being pure aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, the content of manganese in the aluminum-manganese intermediate alloy is 20.0%, and the content of yttrium in the aluminum-yttrium intermediate alloy is 10%; and weighing the raw materials according to a formulation ratio, and heating and melting the raw materials in a resistance furnace, wherein the temperature of the melt is 750-800° C.;

B. mold making: designing and preparing a steel mold of a particular size (having a wall thickness of 35 mm) as an inner mold according to a size of an aluminum alloy ingot; winding a cooling pipe upward from a bottom portion of an outer wall of the steel mold; introducing cooling water into the cooling pipe, with a water temperature of 10° C. and a flow rate of 1 m/s; and using a sand mold as an outer mold, wherein a thickness ratio of the steel mold to the sand mold is 1:2, and a steel mold pouring system is used;

C. refining, impurity removing, and degassing: after the metal melt is fully alloyed, adding a covering agent into the alloy melt for slagging, introducing argon gas for 20 min, standing and skimming, repeating the above process for 2 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 14 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times along a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of and an extrusion speed ensuring that the ingot strain rate is 0.1 $s^{-1}$;

H. heat treatment: heating the isothermal extruded workpiece in the step G to 500° C., holding for 1.0 h, taking the workpiece out of the furnace, and water quenching; and then conducting aging treatment: heating to 180° C., holding for 15.0 h, and then taking the treated workpiece out of the furnace for air cooling.

Comparative Example 3

An Al—Cu—Mg—Mn aluminum alloy includes the following components in percentage by weight: Cu: 4.6%, Mg:

0.6%, Mn: 0.8%, Sc: 0.05%, Zr: 0.1%, wherein Sc:Zr=1:2, and Y: 0.2%, the balance being pure aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, the content of manganese in the aluminum-manganese intermediate alloy is 20.0%, and the content of yttrium in the aluminum-yttrium intermediate alloy is 10%; and weighing the raw materials according to a formulation ratio, and heating and melting the raw materials in a resistance furnace, wherein the temperature of the melt is 750-800° C.;

B. mold making: designing and preparing a steel mold of a particular size (having a wall thickness of 30 mm) as an inner mold according to a size of an aluminum alloy ingot; winding a cooling pipe upward from a bottom portion of an outer wall of the steel mold; introducing cooling water into the cooling pipe, with a water temperature of 10° C. and a flow rate of 1 m/s; and using a sand mold as an outer mold, wherein a thickness ratio of the steel mold to the sand mold is 1:2, and a steel mold pouring system is used;

C. refining, impurity removing, and degassing: after the metal melt is fully alloyed, adding a covering agent into the alloy melt for slagging, introducing argon gas for 15 min, standing and skimming, repeating the above process for 3 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 14 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times along a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of 15:1 and an extrusion speed ensuring that the ingot strain rate is 0.1 $s^{-1}$;

H. heat treatment: first, conducting solid solution treatment: heating the isothermal extruded workpiece in the step G to 500° C., holding for 2 h, taking the workpiece out of the furnace, and water quenching; and then conducting gradient aging treatment: first, heating the workpiece obtained after the solution treatment to 120° C. for 1.0 h, then heating to 200° C. for 7.0 h, and air cooling to obtain a product.

Comparative Example 4

A high-strength Al—Cu—Mg—Mn aluminum alloy includes the following components in percentage by weight: Cu: 4.6%, Mg: 0.6%, Mn: 0.8%, Sc: 0.3%, Zr: 0.1%, wherein Sc:Zr=3:1, and Y: 0.3%, the balance being pure aluminum.

A specific preparation method includes the following steps:

A. smelting: using high-purity aluminum, high-purity magnesium, an aluminum-copper intermediate alloy, an aluminum-scandium intermediate alloy, an aluminum-manganese intermediate alloy, and an aluminum-zirconium intermediate alloy as raw materials, wherein the purity of the high-purity aluminum is 99.9%, the purity of the high-purity magnesium is 99.9%, the content of copper in the aluminum-copper intermediate alloy is 50.0%, the content of scandium in the aluminum-scandium intermediate alloy is 2.0%, the content of zirconium in the aluminum-zirconium intermediate alloy is 40.0%, and the content of manganese in the aluminum-manganese intermediate alloy is 20.0%; and weighing the raw materials according to a formulation ratio, and heating and melting the raw materials in a resistance furnace, wherein the temperature of the melt is 750-800° C.;

B. mold making: designing and preparing a steel mold of a particular size according to a size of an aluminum alloy ingot, C. refining, impurity removing, and degassing: after the metal melt is fully alloyed, adding a covering agent into the alloy melt for slagging, introducing argon gas for 20 min, standing and skimming, repeating the above process for 2 times, and then standing the aluminum alloy melt for 25 min;

D. pouring: after the refining, impurity removal and degasification of the aluminum alloy melt are completed, maintaining the melt at a temperature of 723° C., and pouring the melt to the mold prepared in the step B to cool and solidify to obtain an ingot;

E. homogenizing heat treatment: heating the ingot obtained in the step D to 480±10° C., holding for 14 h, taking the ingot out of the furnace, and air cooling to room temperature;

F. forging pre-deformation: heating the homogenized ingot obtained in the step E in a resistance furnace to 420° C. and holding for 45 min, and then conducting three-dimensional large deformation multi-directional forging using a hydraulic press, with a reduction rate of 2 mm/s, wherein for a first deformation, reduction deformation is carried out along a maximum dimension direction (Y axis), and when a strain of 0.5 is reached, a first turnover reversing deformation is conducted: conducting reversing deformation for multiple times along a radial direction (X axis) perpendicular to the first pressure direction (Y axis), to obtain a multi-rhombus cylindrical blank, and when a strain of 0.5 is reached, a second reversing deformation is conducted: conducting reversing deformation for multiple times a maximum dimension direction between the X axis and the Y axis to obtain a spherical polyhedron; the steps are repeated for 4 times; and finally, reversing deformation is conducted along the X axis to obtain a multi-rhombus cylindrical blank;

G. isothermal extrusion: holding the final blank obtained in the step F at 430° C. for 1.5 h and holding the mold at 430° C. for 30 min, and extruding the ingot with an extrusion ratio of 15:1 and an extrusion speed ensuring that the ingot strain rate is 0.1 $s^{-1}$;

H. heat treatment: first, conducting solid solution treatment: heating the isothermally extruded workpiece in the step G to 500° C., holding for 2 h, taking the workpiece out of the furnace, and water quenching; and then conducting gradient aging treatment: first, heating the workpiece obtained after the solution treatment to 120° C. for 1.0 h, then heating to 200° C. for 7.0 h, and air cooling to obtain a product.

Performance Tests:

The aluminum alloy products prepared in the above examples and comparative examples were tested. The tensile sample sizes were processed according to GB/T 228.1-2010. The average values of the results were taken. The test results are shown in Table 1.

TABLE 1

| | Example 1 | Example 2 | Comparative Example 1 | Comparative Example 2 | Comparative Example 3 | Comparative Example 4 |
|---|---|---|---|---|---|---|
| $\sigma_b$ | 530 MPa | 520 MPa | 450 MPa | 486 MPa | 476 MPa | 460 MPa |
| δ/% | 12 | 16 | 9 | 12 | 12 | 10 |

The present disclosure has been described in detail with reference to preferred embodiments, which however are not intended to limit the present disclosure. Any modifications and substitutions can be made thereto without departing from the principle of the present disclosure, which all fall within the protection scope of the present disclosure.

What is claimed is:

1. A method for preparing an Al—Cu—Mg—Mn aluminum alloy, wherein the Al—Cu—Mg—Mn aluminum alloy comprises the following components in percentage by weight: Cu 4.5-6.3%, Mg: 0.6-1.2%, Mn: 0.6-1.5%, Si: ≤0.5%, Fe: ≤0.5%, Sc: 0.15-0.35%, Zr: 0.1-0.2%, and Y: 0.1-0.3%, the balance being aluminum and non-removable impurities, wherein Sc and Zr are added at a weight ratio of 1-3:1, the method comprising the following steps:

A) smelting by using aluminum having a purity of ≥99.99%, magnesium having a purity of ≥99.95%, an aluminum-copper intermediate alloy having a copper content of ≥50.0%, an aluminum-scandium intermediate alloy having a scandium content of ≥1.0%, an aluminum-manganese intermediate alloy having a manganese content of ≥20.0%, an aluminum-zirconium intermediate alloy having a zirconium content of ≥10.0%, and an aluminum-yttrium intermediate alloy having a yttrium content of ≥10.0% as raw materials; and weighing the raw materials according to a formulation ratio selected such that an aluminum alloy melt obtained by heating and melting the raw materials has Cu 4.5-6.3%, Mg: 0.6-1.2%, Mn: 0.6-1.5%, Si: ≤0.5%, Fe: ≤0.5%, Sc: 0.15-0.35%, Zr: 0.1-0.2%, and Y: 0.1-0.3%, the balance being aluminum and non-removable impurities, wherein Sc and Zr are added at a weight ratio of 1-3:1; and heating and melting the raw materials in a resistance furnace to obtain the aluminum alloy melt;

B) making a mold by designing and preparing a steel mold of a particular size according to a size of an aluminum alloy ingot, wherein the steel mold has a wall thickness of greater than or equal to 30 mm and serves as an inner mold; winding a cooling pipe upward from a bottom portion of an outer wall of the steel mold; introducing cooling water into the cooling pipe, wherein a temperature and a flow rate of the cooling water are controllable; and using a sand mold as an outer mold to make the mold, wherein a thickness ratio of the steel mold to the sand mold is 1:(2-5), a steel mold pouring system is used, and a cooling speed of the mold is controlled by controlling the temperature and the flow rate of the cooling water;

C) refining, impurity removing, and degassing after the aluminum alloy melt is fully alloyed, adding an impurity removal agent into the aluminum alloy melt for slagging, introducing argon gas for 10-20 min, standing and skimming; then repeating the steps of adding the impurity removal agent into the aluminum alloy melt for slagging, introducing argon gas for 10-20 min, and standing and skimming for 2-3 times, and then standing the aluminum alloy melt for more than 20 min;

D) after the refining, impurity removal and degasification of the aluminum alloy melt are completed, maintaining the aluminum alloy melt at a temperature of 720±5° C., and pouring the aluminum alloy melt to the mold prepared in step B to cool and solidify to obtain an ingot;

E) homogenizing heat treating by heating the ingot obtained in the step D to 480±10° C., holding for 13-15 h, taking the ingot out of the furnace, and air cooling to room temperature to provide a homogenized ingot;

F) forging pre-deformation by heating the homogenized ingot obtained in the step E in a resistance furnace to 420-450° C. and holding for 40-60 min, and then conducting three-dimensional large deformation multi-directional forging on the homogenized ingot, with a reduction rate of 1-3 mm/s wherein for a first deformation, reduction deformation is carried out along a maximum dimension direction as an X axis, and when a strain of 0.5-0.8 is reached, a first turnover reversing deformation is conducted by conducting reversing deformation for multiple times along a radial direction perpendicular as a Y axis to a first pressure direction, to obtain a multi-rhombus cylindrical blank, and when a strain of 0.5-0.8 is reached, a second reversing deformation is conducted by conducting reversing deformation 3-5 times along a maximum dimension direction between the X axis and the Y axis to obtain a spherical polyhedron; and finally, reversing deformation is conducted along the X axis to obtain a final multi-rhombus cylindrical blank;

G) isothermal deformation processing by holding the final multi-rhombus cylindrical blank obtained in the step F at 420-450° C. for 1-2 h, and holding the mold at 420-450° C. for 25-35 min, with an extrusion ratio of (10-20):1 and an extrusion speed ensuring that an ingot strain rate is 0.05-0.2 $s^{-1}$; or isothermal forging by holding the blank at 420-450° C. for 1-2 h, and holding the mold at 420-450° C. for 25-40 min, wherein a punching speed of a hydraulic press during forging is 0.05-0.1 mm/s; to obtain an isothermal deformed workpiece by the isothermal deformation processing or the isothermal forging; and H) heat treating by first, conducting solid solution treatment by heating the isothermal deformed workpiece in the step G to 480-520° C., holding for 1-3 h, taking the workpiece out of the furnace, and water quenching; and then conducting gradient aging treatment by first, heating the workpiece obtained after the solution treatment to 100-130° C. for 0.5-1.5 h, then heating to 170-220° C. for 5.0-10.0 h, and air cooling to obtain the product Al—Cu—Mg—Mn aluminum alloy.

2. The method according to claim 1, wherein in step A, the temperature of the aluminum alloy melt after heating and melting is maintained at is 750-800° C.

3. The method according to claim 1, wherein in step F, the homogenized ingot obtained in the step E is heated in the resistance furnace to 420-450° C. and held for 45 min, and then three-dimensional large deformation multi-directional forging is conducted on the homogenized ingot, with a reduction rate of 2 mm/s; for the first deformation, the reduction deformation is carried out along the maximum dimension direction, and when a strain of 0.5 is reached, the first turnover reversing deformation is conducted by conducting the reversing deformation for multiple times along the radial direction perpendicular to the first pressure direction, to obtain the multi-rhombus cylindrical blank, and when a strain of 0.5 is reached, the second reversing deformation is conducted by conducting the reversing deformation 3-5 times along the maximum dimension direction between the X axis and the Y axis to obtain the spherical polyhedron; and finally, the reversing deformation is conducted along the X axis to obtain the final multi-rhombus cylindrical blank.

4. The method according to claim 3, wherein the product Al—Cu—Mg—Mn aluminum alloy has a tensile strength of 520-530 MPa and an elongation of 12%-16%.

5. The method according to claim 1, wherein in the step G, when isothermal deformation process is used, holding the blank at 420-450° C. for 1.5 h, and holding the mold at 420-450° C. for 30 min, with an extrusion ratio of (10-20):1 and an extrusion speed ensuring that the ingot strain rate is 0.1 $s^{-1}$; and when isothermal forging is used, holding the blank at 420-450° C. for 1.5 h, and holding the mold at 420-450° C. for 30 min, wherein the punching speed of the hydraulic press during forging is 0.05 mm/s.

6. The method according to claim 5, wherein the product Al—Cu—Mg—Mn aluminum alloy has a tensile strength of 520-530 MPa and an elongation of 12%-16%.

7. The method according to claim 1, wherein in step H, the solid solution treatment comprises heating the isothermally deformed workpiece to 500° C., holding for 2 h, taking the workpiece out of the furnace, and water quenching.

8. The method according to claim 7, wherein the product Al—Cu—Mg—Mn aluminum alloy has a tensile strength of 520-530 MPa and an elongation of 12%-16%.

9. The method according to claim 1, wherein in the step H, the gradient aging treatment comprises first, heating the workpiece obtained after the solution treatment to 120° C. for 1 h, then heating to 200° C. for 7 h, and air cooling to obtain the product Al—Cu—Mg—Mn aluminum alloy.

10. The method according to claim 9, wherein the product Al—Cu—Mg—Mn aluminum alloy has a tensile strength of 520-530 MPa and an elongation of 12%-16%.

11. The method according to claim 2, wherein the product Al—Cu—Mg—Mn aluminum alloy has a tensile strength of 520-530 MPa and an elongation of 12%-16%.

12. The method according to claim 1, wherein the product-high strength Al—Cu—Mg—Mn aluminum alloy has a tensile strength of 520-530 MPa and an elongation of 12%-16%.

* * * * *